US005586600A

United States Patent [19]

Cribari

[11] Patent Number: 5,586,600

[45] Date of Patent: Dec. 24, 1996

[54] HEAT EXCHANGER

[75] Inventor: John C. Cribari, Oakland, Mich.

[73] Assignee: Valeo Engine Cooling, Inc., Jamestown, N.Y.

[21] Appl. No.: 329,547

[22] Filed: Oct. 26, 1994

[51] Int. Cl.[6] ..... F28F 9/02

[52] U.S. Cl. ..... 165/173; 165/DIG. 482; 29/890.052

[58] Field of Search ..... 165/153, 174, 165/176, 173; 29/890.052

[56] References Cited

U.S. PATENT DOCUMENTS

| | | | |
|---|---|---|---|
| 4,936,381 | 6/1990 | Alley | 165/176 |
| 5,042,578 | 8/1991 | Tanabe | 165/174 |
| 5,209,292 | 5/1993 | Arneson et al. | 165/176 |
| 5,329,995 | 7/1994 | Dey et al. | 165/153 |
| 5,417,277 | 5/1995 | DeGauyer | 165/76 |

*Primary Examiner*—Allen J. Flanigan
*Attorney, Agent, or Firm*—Morgan & Finnegan, LLP

[57] ABSTRACT

A tank part for a heat exchanger manifold of the type comprising separate tank a header parts joined to form a tubular manifold comprises an elongate channel-shaped member (18) and at least one partition member (6,8) fitted transversely therein, wherein the tank part is provided with inwardly protruding deformed regions on opposite sides of the or each partition to hold this in position, which comprise inwardly protruding dimples (24), and/or tabs (40,42) bent from portions upstanding from edge regions of the tank part.

10 Claims, 5 Drawing Sheets

HEAT EXCHANGER

FIELD OF THE INVENTION

The present invention relates to an end tank for use in a manifold for a heat exchanger of the type in which a tank part is joined to a separate header part to form the manifold, and in further aspects to such a manifold, and to a method of assembly thereof.

BACKGROUND OF THE INVENTION

Heat exchangers of the type which are typically employed in air conditioning systems for example for automobiles comprise opposed manifolds provided with a large number of heat exchange tubes which carry coolant fluid between the manifolds. Each manifold comprises a tubular body which is internally divided by partitions or walls into a plurality of compartments to define a tortuous path for the coolant fluid through the heat exchange tubes. Such manifolds may be formed of two channel-like half shells which are joined together along their longitudinal edges to form the manifold, with the partitions located transversely within the manifold.

With such an assembly, particular difficulties arise in accurately locating the partitions or wall members within the manifold. If these are not accurately located problems of leaking of the manifold can arise, as well as problems of partial obstructions of the heat exchange openings. It is known to seat these partitions in circumferential grooves machined on the internal surfaces of the tank and header part which serve to position the partitions longitudinally therein. The problem with this arrangement is that in forming the grooves the wall of the tank material is liable to deform, and in particular to elongate so that the intended groove locations cannot be accurately maintained. It is also known to provide the tank part with seating slots extending entirely through the wall thickness into which the partitions are laterally fitted from outside of the manifold. It is similarly difficult to accurately locate the slots at the desired positions. Moreover, the slots provide additional possible leakage paths for coolant fluid.

In U.S. Pat. No. 5,233,756 there is disclosed a tubular manifold in which the partitions are held in position by deforming the tubular manifold wall on either side of the partitions by applying a circumferential beading. The tubular wall here is also deformed about the apertures in the wall provided for the heat exchange tubes, which deformation further serves to retain the partitions in position. This concept is disclosed in relation to a manifold which is of the type which has a tubular unitary construction whereby the partitions must be introduced into the manifold from an end of the tube prior to the deformation.

SUMMARY OF THE PRESENT INVENTION

The present invention seeks to overcome the problems referred to above.

According to a first aspect of the present invention there is provided a tank part for a heat exchanger, for connection to a header part to form a tubular heat exchanger manifold, which tank part comprises an elongate generally channel-shaped member and at least one partition member fitted in the channel to extend transversely thereaccross, wherein the tank part is provided with inwardly deformed regions on opposite sides, in the longitudinal direction of the tank part, of the or each partition member to retain the or each partition in position.

In a further aspect the present invention provides a heat exchanger manifold comprising elongate generally channel-shaped tank and header parts joined to form a tubular manifold body, and at least one transverse partition member fitted therein, wherein the tank part is provided with inwardly deformed regions on opposite sides, in the longitudinal direction of the manifold, of the or each partition member.

In a further aspect the present invention provides a heat exchanger comprising at least one tubular manifold comprising separate tank and header parts joined along logitudinal edges, said header part defining a plurality of apertures therein; a plurality of heat exchange tubes each extending through a respective aperture to communicate internally with the manifold; and at least one partition member disposed transversely in the manifold; wherein the tank part is provided with inwardly extending deformed regions on opposite sides of the or each partition member.

Preferably, the inwardly deformed regions comprise inwardly protruding dimples formed in the wall of the tank part.

These dimples provide a particularly simple yet effective means of maintaining the partition members accurately in position.

As an alternative to, or in addition to, the dimple-like protrusions, the channel member may have longitudinal edge regions which are provided with upstanding portions at the location of the or each partition, and regions constituting tabs which are bent inwardly from these upstanding portions on opposite sides of the or each partition, in order to hold an upper region of the or each partition in position.

These upstanding portions may comprise substantially rectangular portions, corner regions of which are bent inwardly on the opposite faces of the partitions.

Alternatively, each upstanding portion may be provided with a finger-like upward extension of the upstanding portion, constituting the tab which is bent inwardly towards the opposite tank edge region, substantially parallel to the plane of the partition, and with the finger-like tab at one edge region disposed on one side of the partition with that of the opposite tank edge region disposed on the opposite side of the partition.

By accurately retaining the upper regions of the partitions in position against the tank sidewall problems of leakage at these regions are reduced.

In a further aspect the invention provides a method of assembly of a tank part for a heat exchanger manifold of the type comprising separate tank and header parts joined to form a tubular manifold, comprising the steps of:

a) providing a generally channel-shaped tank part and at least one partition member;

b) fitting the or each partition member into the channel to extend transversely across the channel; and c) inwardly deforming the tank part on opposite sides of the or each partition member to retain this in position.

Preferably, in step c) a punch tool directed at the outside of the tank part is employed to form inwardly protruding dimples. In a preferred embodiment the tank part is provided with portions upstanding from the longitudinal edges thereof, and in step c) regions of these upstanding portions are bent inwardly on opposite sides of the or each partition.

Further features and advantages of the invention will appear more clearly from the detailed description of a preferred embodiment of the invention which follows, being given by way of example only and with reference to the accompanying drawings.

BRIEF DESCRIPTION OF THE DRAWINGS

FIG. 2(*b*) is an end view looking in the direction of the arrow B in FIG. 2(*a*);

DETAILED DESCRIPTION OF THE PREFERRED EMBODIMENT

Figure 1:
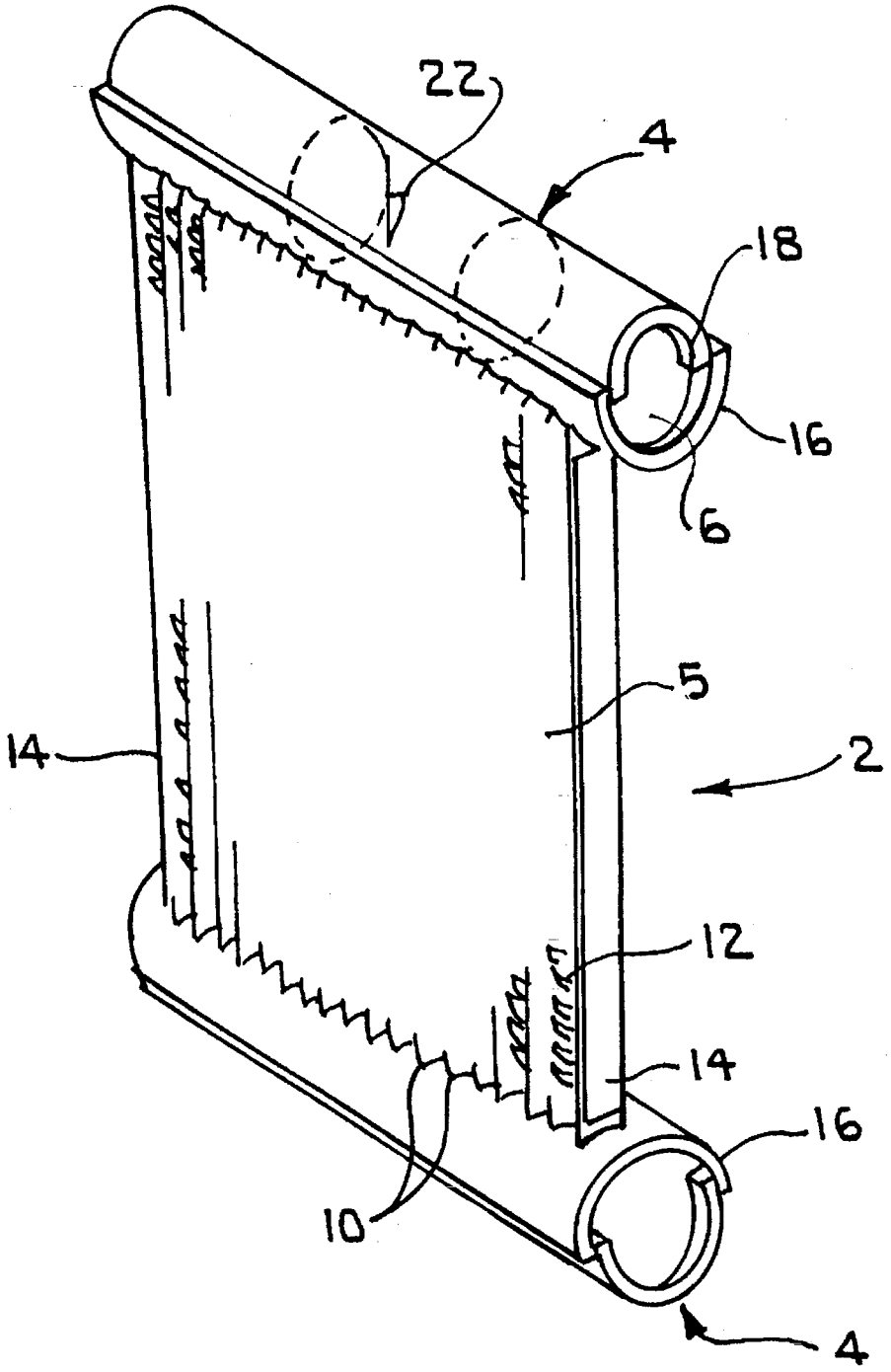
FIG. 1 is a view of a heat exchanger.

FIG. 1 shows part of a heat exchanger generally designated for use for example as a condenser in an automobile air conditioning system. The heat exchanger 2 comprises opposed tubular manifolds 4 which are connected on either side of a heat exchange core 5. The manifold 4 is in the form of a tubular housing which is closed at opposite ends by means of transverse baffles or partitions 6 which constitute end walls, so as to define an interior space which is subdivided by intermediate partitions or baffles 8 which constitute internal walls into a plurality of internal compartments. The term "partitions" is used herein to denote both the members defining the end walls and those defining internal walls.

As is conventional, the heat exchange core 5 comprises a plurality of heat exchange tubes 10 extending into apertures formed in the manifolds to communicate internally therewith. These tubes 10 are formed in a conventional manner by extrusion. The internal division of the manifolds is such as to define a tortuous multi-pass pathway for coolant fluid (typically a refrigerant). Inserts 12 comprising bands of sheet metal which are curved or folded into a corrugated or wave-like form are located in the spaces between the heat exchange tubes 10, or between the tubes 12 and end plates 14 so as to be in thermal contact with the tubes. These serve to increase the effective surface area of the heat exchange surfaces.

The manifolds 4 each comprise a header part 16 and tank part 18 which together define the tubular manifold. The header part 16 is an elongate, channel-shaped member of transverse cross-section of generally semicircular annular shape. The header part 16 is provided with the apertures into which the heat exchange tubes 10 extend. The tank part 18 is also of elongate channel-shaped form having a transverse cross-section of generally semicircular annular form.

As shown, the header part 16 is of a larger radius than the tank part 18, so that the longitudinal edge regions 20 of the tank part 18 are received through an interference fit within the open side of the channel-shaped header part 16, engaging an edge region 22 thereof. It can also be arranged that the tank part 18, in transverse section, extends through a part circle which is greater than a true semicircle, thereby providing a significant degree of overlap between the engaged edge surfaces 20 and 22. The partitions 6,8 comprise disc-shaped or plate-like elements which are appropriately shaped to fit in transverse relation within the space between the assembled header part 16 and tank part 18, having a peripheral surface consisting of two generally semicircular regions of different radius.

Figure 2A:
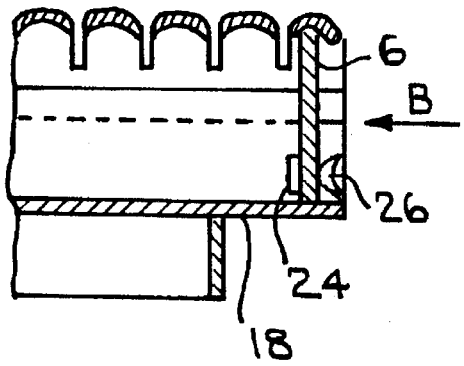
FIG. 2(*a*) is a longitudinal cross-sectional view of an end region of the manifold of the heat exchanger, in accordance with the present invention.
Figure 2B:
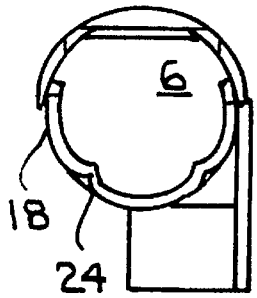
Figure 3:
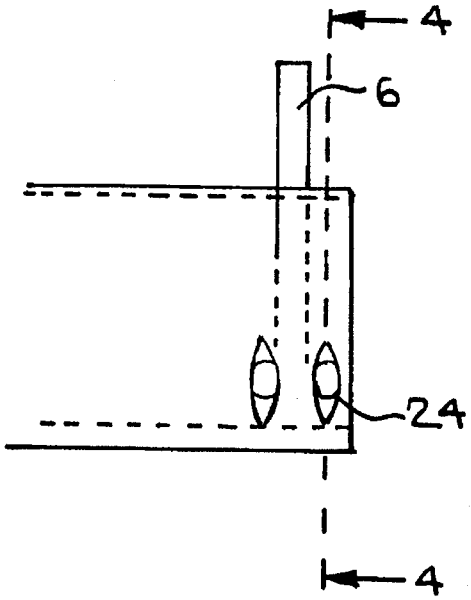
FIG. 3 is a side view of an end region of a tank part of the manifold showing a partition fitted therein.
Figure 4:
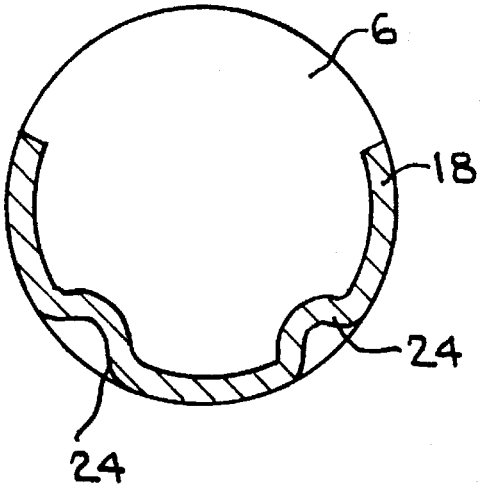
FIG. 4 is a cross-sectional view along the line A—A of FIG. 3.

As can be seen in FIGS. 2 to 4, the partitions 6,8 are held in position within the tank part 18 by means of localised deformed regions 24 formed in the wall of the tank part 18. These regions 24 are in the manner of dimples protruding inwardly into the tank part 18, and are provided on opposite sides (in the longitudinal direction of the tank part 18) of each partition, at transversely spaced locations near the bottom of the tank part 18, as best seen in FIG. 4.

Figure 5:
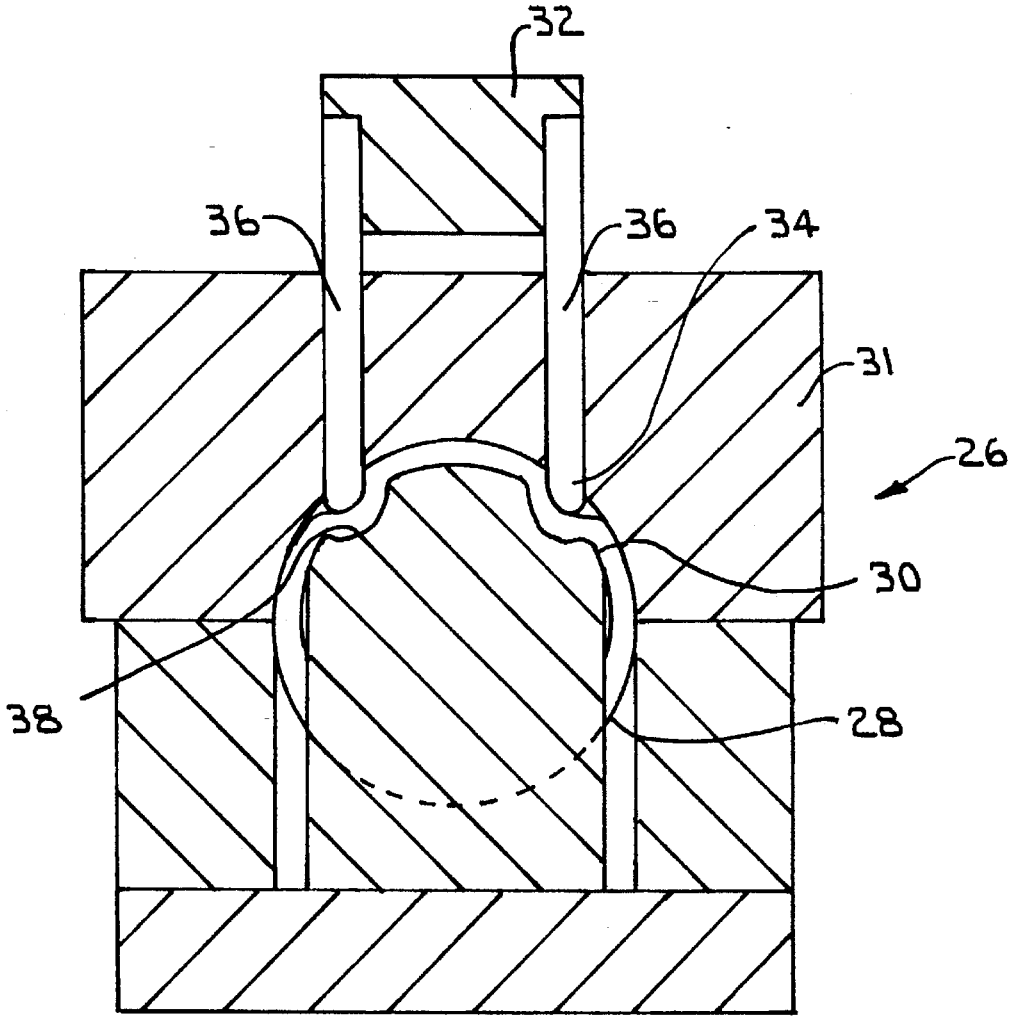
FIG. 5 shows a punch assembly for deforming the tank part.

FIG. 5 shows a tool assembly 26 for forming the deformed regions 24, the tool assembly comprising a lower tool half having a lower stationary die 28 having a shaped surface 30 to receive the tank part 18 into which the partitions 6,8 have been fitted, an upper tool half having an upper die part 31 and a punch tool 32. The punch tool 32 has punch heads 34 arranged to slide in bores 36 in the part 31. The shaped die surface 30 is provided with dimple-shaped recesses 38. In operation, as the punch 32 impacts the tank part 18, and this is deformed to give dimples 24 having a shape defined between the punch heads 34 and recesses 38. A similar tool assembly will be provided at each partition location.

Figure 6:
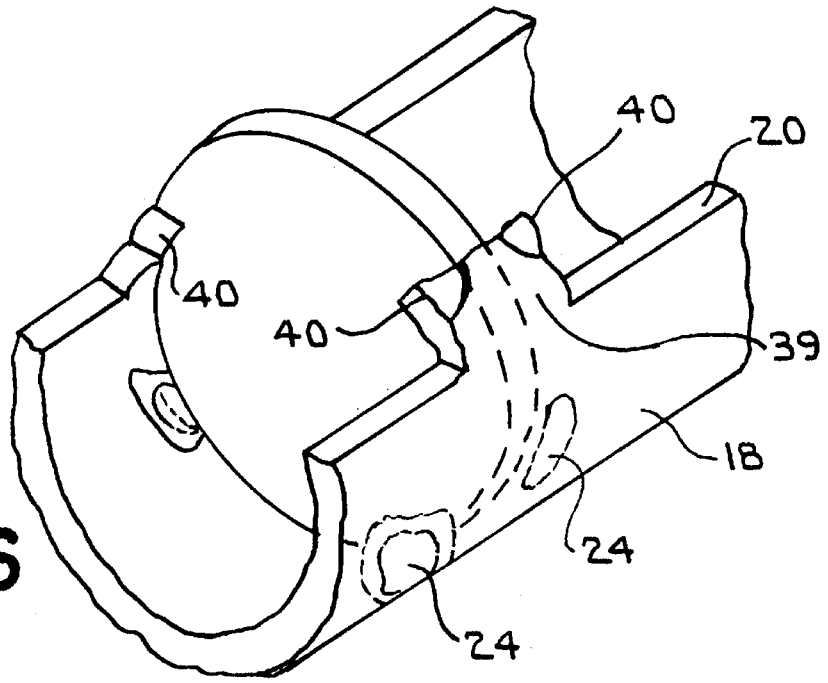
FIG. 6 is a perspective view of the region of a tank part at the location of an internal partition, provided with additional retaining means.
Figure 7:
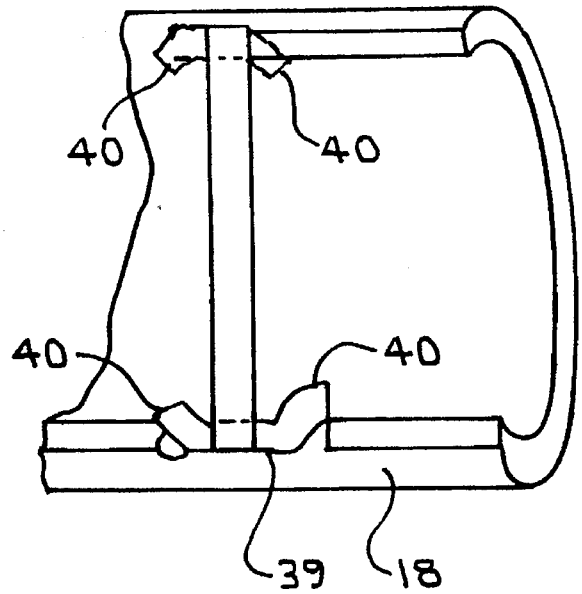
FIG. 7 is a top view of the region of the tank part shown in FIG. 6.

The tank part 18 may be modified, as shown in FIGS. 6 and 7, by providing the tank with "bend-over tabs" which are deformed in order to locate and retain upper regions of the the partitions 6,8 in position. (These can be provided as an alternative to the dimples 24, but are preferably provided in addition thereto). These comprise generally rectangular portions 39 which upstand from the edge regions 20 of the tank part, having corner regions 40 which constitute bend-over tabs bent on the opposite sides of the partitions 6,8 to engage the opposite sides, or at least constrain the partitions from movement. As best seen in FIG. 6, the upstanding portions 39 continue the curved profile of the tank wall with the larger-diameter portion of each partition engaging on the top of these portions 39. Typical dimensions for the portions 39 are 6 mm in length (in the longitudinal direction of the tank part), and 1.0 mm in height above the remainder of the tank side wall.

Appropriate tooling for deforming the corner regions 40 inwardly may be provided at the same location as the tool assembly 26 for forming the dimples, or such may be provided at a separate tool station.

Figure 8:
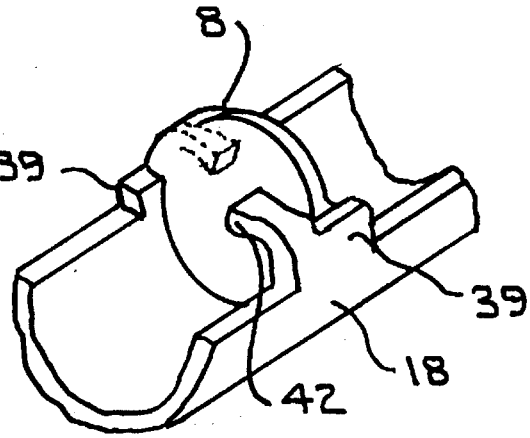
FIG. 8 is a perspective view of a region of the tank part at the location of an internal partition showing an alternative retaining means.

FIGS. 7 and 8 show an alternative embodiment of the tank, employing bend-over tabs. In this embodiment each of the portions 39 upstanding from the upper edge regions 20 of the tank part 18 is formed with a tab in the form of an upstanding finger 42 disposed longitudinally adjacent the partition to engage one side of the partition, with the finger of the upstanding portion of the opposite sidewall disposed to engage the opposite partition side. During assembly, once the partition has been fitted in position, the tabs 42 are bent inwardly into the tank part 18, substantially parallel to the sides of the partitions. In this way, the partitions 6,8 are held in position at their upper regions. The accurate positioning of the upper regions of the partitions 6,8 is important to ensure good sealing between the partitions and tank part, and between header part and tank part in the region of the partitions.

Figure 9:
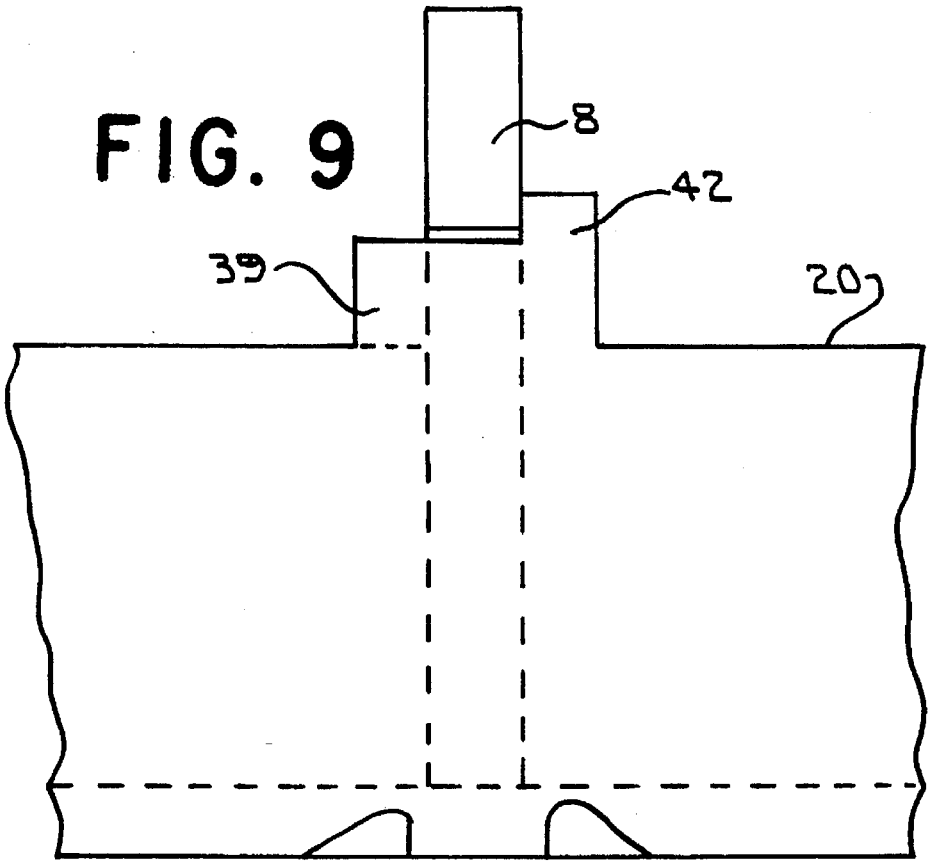
FIG. 9 is a side view of the region of the tank part shown in FIG. 8.

Although the embodiment of FIGS. 8 and 9 has only a single finger, it may also be arranged that a pair of fingers are provided at each tab, in order to engage both faces of the paritition at each edge thereof.

The heat exchanger manifold 2 is assembled by fitting the partitions down into the channel-shaped tank part 18 through the open side of the channel, or, in the case where the tank part 18 has a profile which extends through greater than 180°, by sliding the partitions into the tank through one or other end thereof. The tank part is then arranged in the tool assembly of FIG. 5 to provide the dimples as described above. If the retaining means of FIGS. 6 and 7 or 8 and 9 are employed, the bend-over tabs of the tank part are then subsequently deformed. The header part 16 is then fitted over the tank part 18, so that the longitudinal edges thereof overlap. The manifold is then connected to the heat exchanger core 5 in the conventional manner, with the ends of the heat exchanger tubes 10 being received within respective apertures in the header part 16.

The above described method of assembly provides a minimum amount of distortion to the tank, and provides a very precise means of accurately holding the partitions in their correct positions, minimising leakage.

Sealing between the edges of the partitions 6,8 and the inner surface of the manifold is obtained by brazing using a fusible metallic coating which is melted by heating the assembled heat exchanger in an oven. The coating is preferably provided on the partitions themselves so that they can be brazed to the inner wall of the manifold, and on the outer surface of the manifold surface so that this can be brazed to the heat exchange tubes.

What is claimed is:

1. A tank part for connection to a header part to form a heat exchanger manifold, which tank part comprises an elongate generally channel-shaped member and at least one partition member fitted in the channel to extend transversely thereacross, wherein the tank part is provided with inwardly deformed regions on opposite sides of the at least one partition member in the longitudinal direction of the tank part to retain the at least one partition in position, wherein the inwardly deformed regions have inwardly protruding dimples formed in the wall of the tank part, and wherein two pairs of dimples are provided for the at least one partition.

2. A tank part for connection to a header part to form a heat exchanger manifold, which tank part comprises an elongate generally channel-shaped member and at least one partition member fitted in the channel to extend transversely thereacross, wherein the tank part is provided with inwardly deformed regions on opposite sides of the at least one partition member in the longitudinal direction of the tank part to retain the at least one partition in position, and wherein the channel member has longitudinal edge regions which are provided with upstanding portions at the location of the at least one partition, regions of these upstanding portions constituting tabs which are bent inwardly on the opposite sides of the at least one partition in order to hold an upper region thereof in position.

3. A tank part according to claim 2, wherein the upstanding portions comprise substantially rectangular tabs, corner regions of which are inwardly bent over on the opposite sides of the at least one partition.

4. A tank part according to claim 2 wherein each upstanding portion is provided with a finger-like upward extension of the upstanding portion, constituting the tab which is bent inwardly towards the opposite tank edge region, substantially parallel to the plane of the partition, and wherein the finger-like tab at one edge region is disposed on one side of the partition with that of the opposite tank edge region disposed on the opposite side of the partition.

5. A heat exchanger manifold comprising elongate generally channel-shaped tank and header parts joined to form a tubular manifold body, and at least one transverse partition member fitted therein, wherein the tank part is provided with inwardly deformed regions on opposite sides, in the longitudinal direction of the manifold, of the at least one partition member, and wherein the inwardly deformed regions have two pairs of inwardly protruding dimples formed in the wall of the tank part.

6. A heat exchanger manifold according to claim 5, wherein the tank part has longitudinal edge regions which are provided with upstanding portions at the location of the at least one partition, and regions constituting tabs bent inwardly from these upstanding portions on opposite sides of the at least one partition to hold an upper region thereof in position.

7. A heat exchanger comprising at least one tubular manifold having separate tank and header parts joined along longitudinal edges thereof, said header part defining a plurality of apertures therein; a plurality of heat exchange tubes each extending through a respective aperture to communicate internally with the manifold and at least one partition member disposed transversely in the manifold; wherein the tank part is provided with inwardly extending deformed regions on opposite sides of the at least one partition member, and wherein the inwardly deformed regions have two pairs of inwardly protruding dimples formed in the wall of the tank part.

8. A heat exchanger according to claim 7, wherein the tank part has longitudinal edge regions which are provided with upstanding portions at the location of the at least one partition, and tabs bent inwardly from these upstanding portions on opposite sides of the at least one partition to hold an upper region thereof in position.

9. A method of assembly of a tank part for a heat exchanger manifold of the type having separate tank and header parts joined to form a tubular manifold comprising the steps of:

a) providing a generally channel-shaped tank part and at least one partition member;

b) fitting the at least one partition member into the channel to extend transversely across the channel;

c) inwardly deforming the tank part on opposite sides of the at least one partition member to retain this in position; and wherein in step c) a punch tool directed at the outside of the tank part is employed to form inwardly protruding dimples.

10. A method of assembly of a tank part for a heat exchanger manifold of the type having separate tank and header parts joined to form a tubular manifold comprising the steps of:

a) providing a generally channel-shaped tank part and at least one partition member;

b) fitting the at least one partition member into the channel to extend transversely across the channel;

c) inwardly deforming the tank part on opposite sides of the at least one partition member to retain this in position; and wherein the tank part is provided with portions upstanding from the longitudinal edges thereof, and in step c) regions of these upstanding portions are bent inwardly on opposite sides of the at least one partition.

* * * * *